US012221306B2

(12) United States Patent
Tokoro et al.

(10) Patent No.: US 12,221,306 B2
(45) Date of Patent: Feb. 11, 2025

(54) DOCUMENT CONVEYING DEVICE

(71) Applicant: KYOCERA Document Solutions Inc., Osaka (JP)

(72) Inventors: Yoshitaka Tokoro, Osaka (JP); Takafumi Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 305 days.

(21) Appl. No.: 18/064,647

(22) Filed: Dec. 12, 2022

(65) Prior Publication Data

US 2023/0192427 A1 Jun. 22, 2023

(30) Foreign Application Priority Data

Dec. 16, 2021 (JP) ..... 2021-204395

(51) Int. Cl.
*B65H 1/14* (2006.01)

(52) U.S. Cl.
CPC ..... *B65H 1/14* (2013.01); *B65H 2403/41* (2013.01); *B65H 2801/39* (2013.01)

(58) Field of Classification Search
CPC ..... B65H 1/14; B65H 1/18; B65H 2405/3321
See application file for complete search history.

(56) References Cited

U.S. PATENT DOCUMENTS 5,839,015 A * 11/1998 Faguy ..... B65H 1/18 399/23
10,730,709 B2 * 8/2020 Lo ..... B65H 7/00
11,279,576 B2 * 3/2022 Matsushima ..... B65H 1/04
11,597,616 B2 * 3/2023 Fukasawa ..... B65H 7/14
11,873,186 B2 * 1/2024 Hagihara ..... B65H 31/02
11,939,177 B2 * 3/2024 Nishihara ..... B65H 1/04
12,110,203 B2 * 10/2024 Ando ..... B65H 3/54
2021/0114834 A1 * 4/2021 Tashiro ..... B65H 3/0684
2023/0286770 A1 * 9/2023 Hagihara ..... B65H 1/14
2023/0391567 A1 * 12/2023 Nakagawa ..... B65H 1/12
2024/0025678 A1 * 1/2024 Ando ..... B65H 1/14

FOREIGN PATENT DOCUMENTS

JP H10-167545 A 6/1998

* cited by examiner

*Primary Examiner* — Patrick Cicchino
(74) *Attorney, Agent, or Firm* — Studebaker & Brackett PC

(57) ABSTRACT

A document conveying device according to the present disclosure includes a sheet feeding tray, a discharge tray, a feeding roller, a first lifting mechanism, a conveying mechanism, a support member and a second mechanism. On the sheet feeding tray, a document is stacked. The discharge tray is provided below the sheet feeding tray. The feeding roller feeds the document on the sheet feeding tray. The first lifting mechanism supports both end portions of the sheet feeding tray in a width direction intersecting a conveying direction of the document, and lifts and lowers the sheet feeding tray such that an upper surface of the document comes in contact with the feeding roller. The support member supports the sheet feeding feed tray on an upstream side of the first lifting mechanism in the conveying direction. The second lifting mechanism lifts and lowers the support member in synchronization with the sheet feeding tray.

5 Claims, 6 Drawing Sheets

DOCUMENT CONVEYING DEVICE

INCORPORATION BY REFERENCE

This application is based on and claims the benefit of priority from Japanese patent application No. 2021-204395 filed on Dec. 16, 2021, which is incorporated by reference in its entirety.

BACKGROUND

The present disclosure relates to a document conveying device which conveys a document to a reading position.

In recent years, a request for a large capacity document conveying device provided in a document reading device is increased, and a technology for achieving a large capacity has been discussed. For example, it is proposed to increase a stacking space between a discharge tray and a sheet feeding tray by lifting the sheet feeding tray as the sheets stacked on the lifting type sheet feeding tray is conveyed to the discharge tray by the sheet conveying mechanism.

In the above configuration, the downstream portion of the sheet feeding tray in the conveying direction is supported by the main body of the document conveying device in a liftable and lowerable manner. Since the center of gravity of the sheet bundle stacked on the sheet feeding tray is located on the upstream side of the supported portion of the sheet feeding tray in the conveying direction, a downward bending moment acts on the sheet feeding tray around the supported portion. The larger the size of the sheet in the conveying direction, the greater the bending moment because the center of gravity is located on the upstream side in the conveying direction. If the number of sheets that can be stacked on the sheet feeding tray increases due to the increase in capacity, the posture change and deformation of the sheet feeding tray may occur, causing decrease in conveyancing accuracy.

SUMMARY

In accordance with one aspect of the present disclosure, a document conveying device according to the present disclosure includes a sheet feeding tray, a discharge tray, a feeding roller, a first lifting mechanism, a conveying mechanism, a support member and a second mechanism. On the sheet feeding tray, a document is stacked. The discharge tray is provided below the sheet feeding tray. The feeding roller feeds the document on the sheet feeding tray one by one. The first lifting mechanism supports both end portions of the sheet feeding tray in a width direction intersecting a conveying direction of the document on the sheet feeding tray, and lifts and lowers the sheet feeding tray such that an upper surface of the document comes in contact with the feeding roller. The conveying mechanism conveys the document fed by the feeding roller to the discharge tray through a reading position. The support member supports the sheet feeding feed tray on an upstream side of the first lifting mechanism in the conveying direction. The second lifting mechanism lifts and lowers the support member in synchronization with the sheet feeding tray.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, a document conveying device 120 and an image forming apparatus 100 according to one embodiment of the present disclosure will be described.

Figure 1:
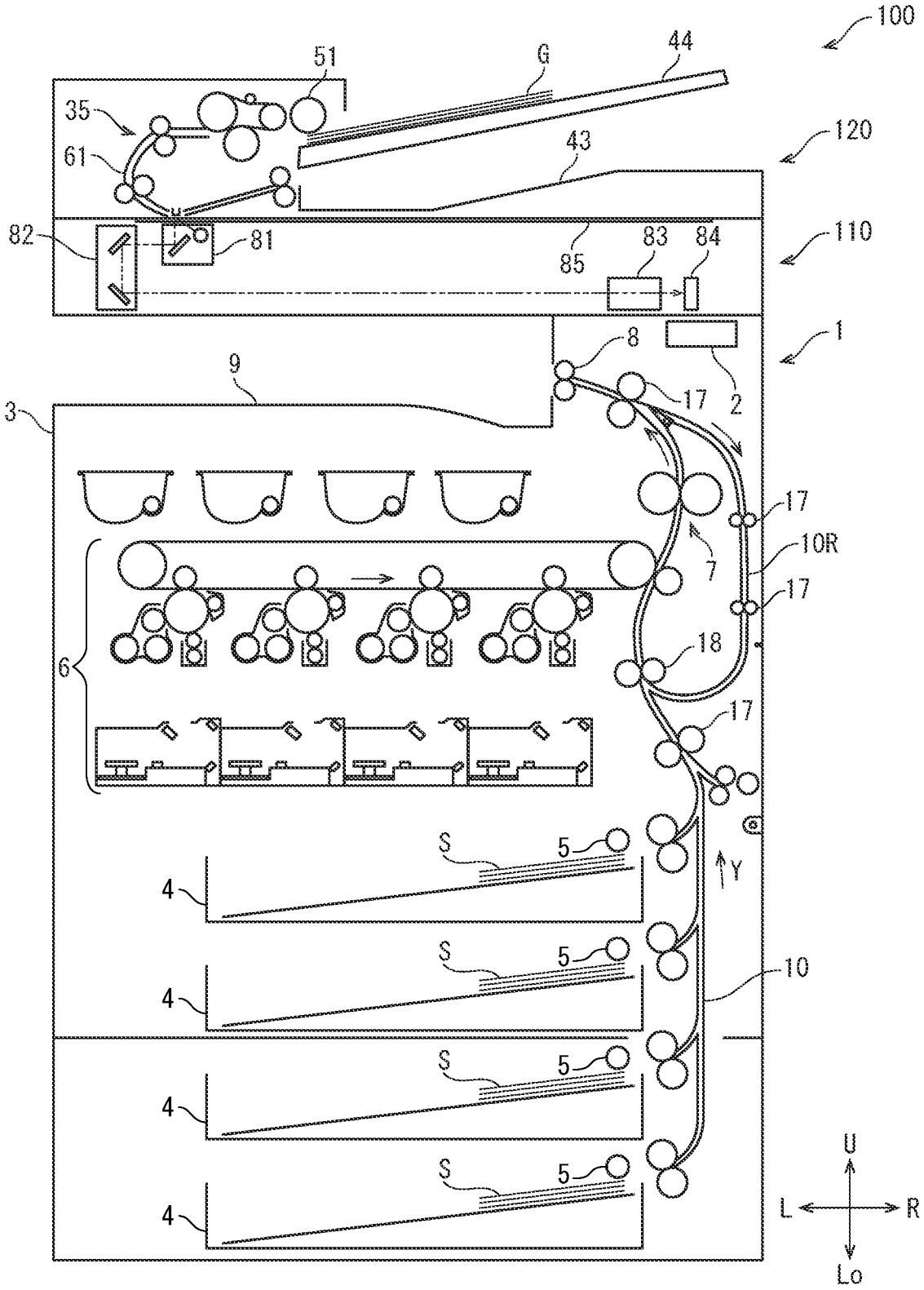
FIG. 1 is a front view schematically showing an inner structure of an image forming apparatus according to one embodiment of the present disclosure.

First, an entire structure of the image forming apparatus 100 will be described. FIG. 1 is a front view schematically showing an inner structure of the image forming apparatus 100. Hereafter, the front side of the paper plane on which FIG. 1 is drawn is defined as the front side of the image forming apparatus 100, and the left-and-right direction is described with reference to the direction in which the image forming apparatus 100 is viewed from the front side. In each figure, U, Lo, L, R, Fr and Rr indicate upper, lower, left, right, front and rear, respectively.

The image forming apparatus 100 includes a printer 1, a scanner 110 and a document conveying device 120. The scanner 110 is provided above the printer 1, and the document conveying device 120 is provided above the scanner 110. The document conveying device 120 conveys the document G through a reading position of the scanner 110. The scanner 110 is a flatbed type image scanner, and reads the document G to generate image data. The printer 1 forms an image based on the image data on the sheet S. While the present embodiment shows an example in which the printer 1 forms the image by an electrophotographic method, the printer 1 may be configured to form an image by an inkjet method.

The printer 1 includes a box-shaped main body housing 3. In the lower portion of the inside of the main body housing 3, a sheet feeding cassette 4 in which the sheet S is stored and a sheet feeding roller 5 which feeds the sheet S from the sheet feeding cassette 4 rightward are provided. Above the sheet feeding cassette 4, an image forming device 6 which forms a toner image in an electrophotographic method is provided, and on the right upper side of the image forming device 6, a fixing device 7 which fixes the toner image to the sheet S is provided. Above the fixing device 7, a discharge roller 8 which discharges the sheet S on which the toner image is fixed and a discharge tray 9 on which the discharged sheet S is stacked are provided.

Inside the main body housing 3, a conveyance path 10 is provided from the sheet feeding roller 5 through the image forming device 6 and the fixing device 7 to the discharge roller 8. The conveyance path 10 is formed mainly of plate-like members facing each other with a gap for passing the sheet S, and conveyance rollers 17 which hold and convey the sheet S are provided at multiple positions in the conveying direction Y. A registration roller 18 is provided on the upstream of the image forming device 6 in the conveying direction Y. On the right side of the fixing device 7, an inversion conveyance path 10R branching from the conveyance path 10 on the downstream of the fixing device 7 in the conveying direction Y and merging with the conveyance path 10 on the upstream of the registration roller 18 in the conveying direction Y is provided.

A controller 2 is provided with an arithmetic part and a storage part (not shown). The arithmetic part is, for example, a CPU (Central Processing Unit). The storage part includes storage media, such as ROM (Read Only Memory), RAM (Random Access Memory) and EEPROM (Electrically Erasable Programmable Read Only Memory). The arithmetic part performs various processes by reading and executing the control program stored in the storage part. The controller 2 may be realized only by an integrated circuit without using software.

A display operation part (not shown) is provided on the front side of the scanner 110. The display operation part includes a display panel, a touch panel provided on the display surface of the display panel and a keypad adjacent to the display panel (not shown). The controller 2 makes the display panel display a screen showing the operation menu, status or the others of the printer 1 and the scanner 110, and controls each part of the printer 1 and the scanner 110 according to the operation detected by the touch panel and the keypad.

The basic image forming operation of the printer 1 is as follows. When a single-sided printing job is input to the printer 1 from the display operation part or an external computer, the sheet feeding roller 5 feeds the sheet S from the sheet feeding cassette 4 to the conveyance path 10, the registration roller 18 whose rotation is stopped corrects the skew of the sheet S, and the registration roller 18 feeds the sheet S to the image forming device 6 at a prescribed timing. The image forming device 6 forms a toner image on the sheet S by an electrophotographic method. Subsequently, the fixing device 7 melts the toner image while holding and conveying the sheet S to fix the toner image on the sheet S. The discharge roller 8 discharges the sheet S to the discharge tray 9. In the case of duplex printing, the sheet S on which the toner image is fixed on the first side is fed to the conveyance path 10 via the inversion conveyance path 10R, and then the toner image is transferred to the second side of the sheet S.

[Scanner] The scanner 110 includes a first carriage 81 with a light source and a reflection mirror, a second carriage 82 with two reflection mirrors, a lens 83 for focusing light, an imaging element 84 for converting the focused light into image data, and a contact glass 85 on which the document G is placed.

The basic document reading operation of the scanner 110 is as follows. When the user places the document G on the upper surface of the contact glass 85 and gives a reading instruction to the scanner 110, the first carriage 81 moves rightward at a speed V while the second carriage 82 moving rightward at a speed V/2. During this time, the light source irradiates the document G with light, and the reflected light reflected by the document G is reflected by the reflection mirror of the first carriage 81 and the reflection mirrors of the second carriage 82, guided to the lens 83, focused by the imaging element 84, and converted into an image signal. The image signal is output to the controller 2 of the printer 1 and converted into the image data.

Figure 2:
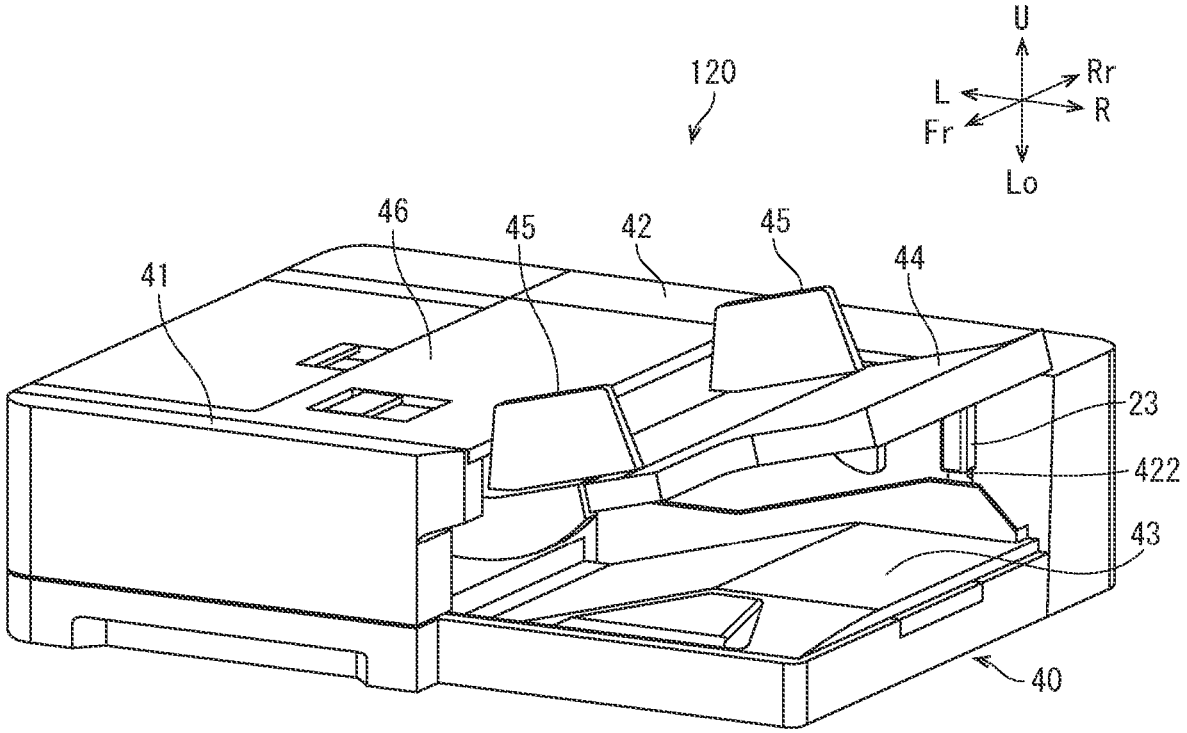
FIG. 2 is a perspective view showing an appearance of a document conveying device according to the embodiment of the present disclosure.
Figure 3:
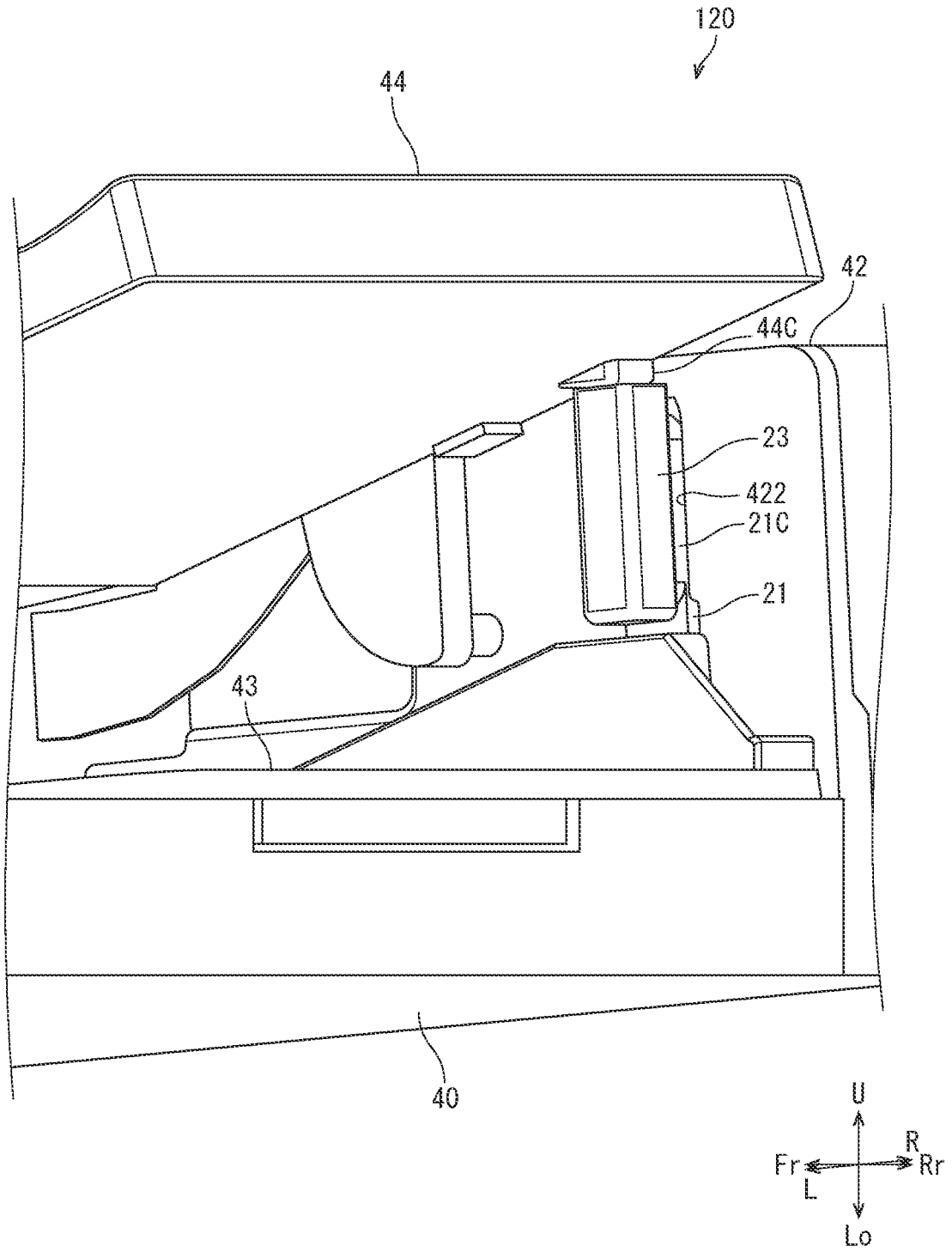
FIG. 3 is a perspective view showing a support member and its periphery according to the embodiment of the present disclosure.
Figure 4:
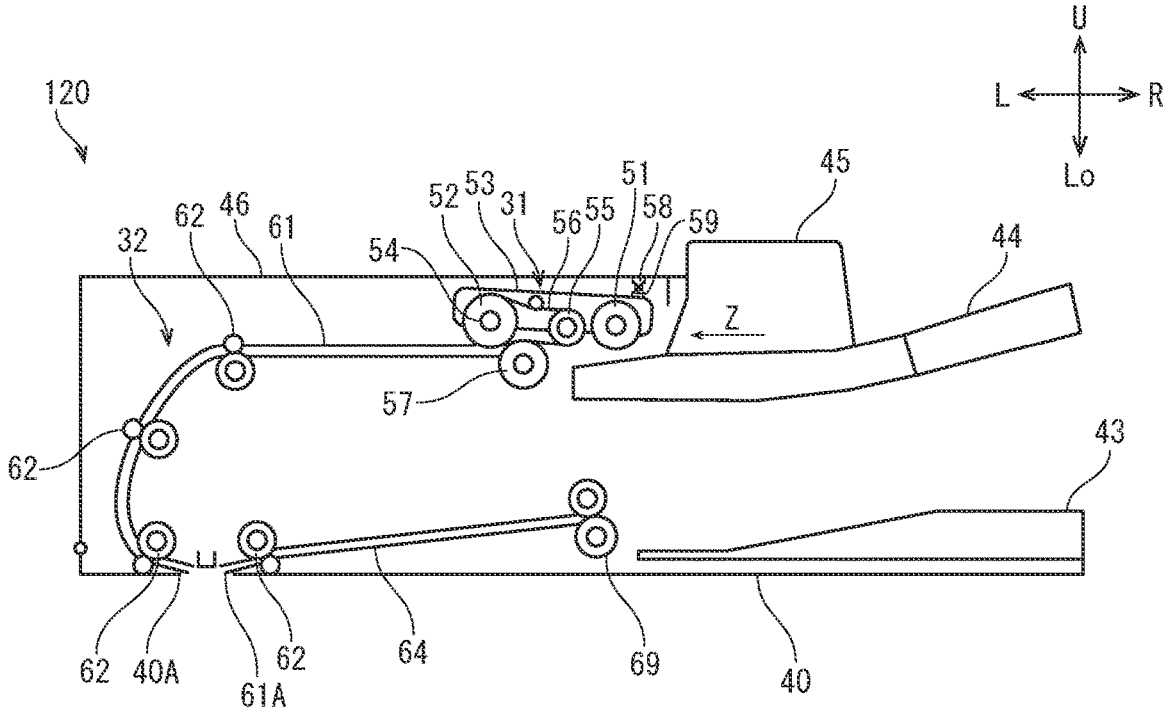
FIG. 4 is a front view schematically showing a sheet feeding mechanism and a conveying mechanism according to the embodiment of the present disclosure.
Figure 5:
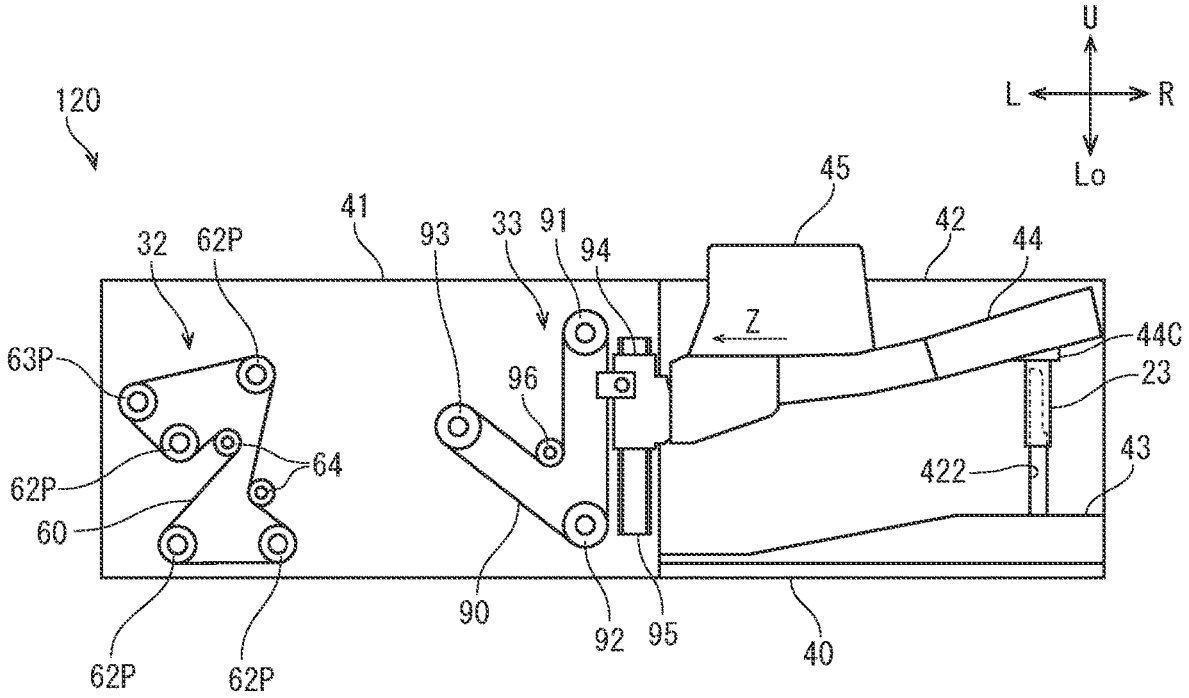
FIG. 5 is a front view schematically showing the conveying mechanism and a first lifting mechanism according to the embodiment of the present disclosure.
Figure 6:
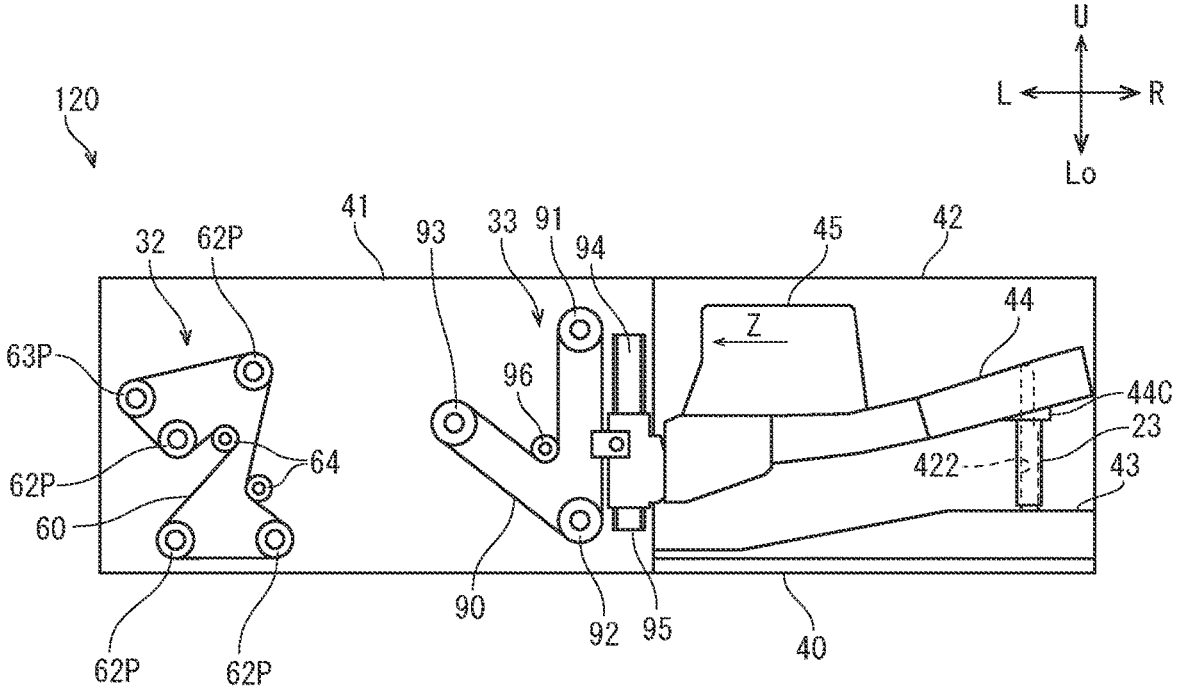
FIG. 6 is a front view schematically showing the conveying mechanism and the first lifting mechanism according to the embodiment of the present disclosure.
Figure 7:
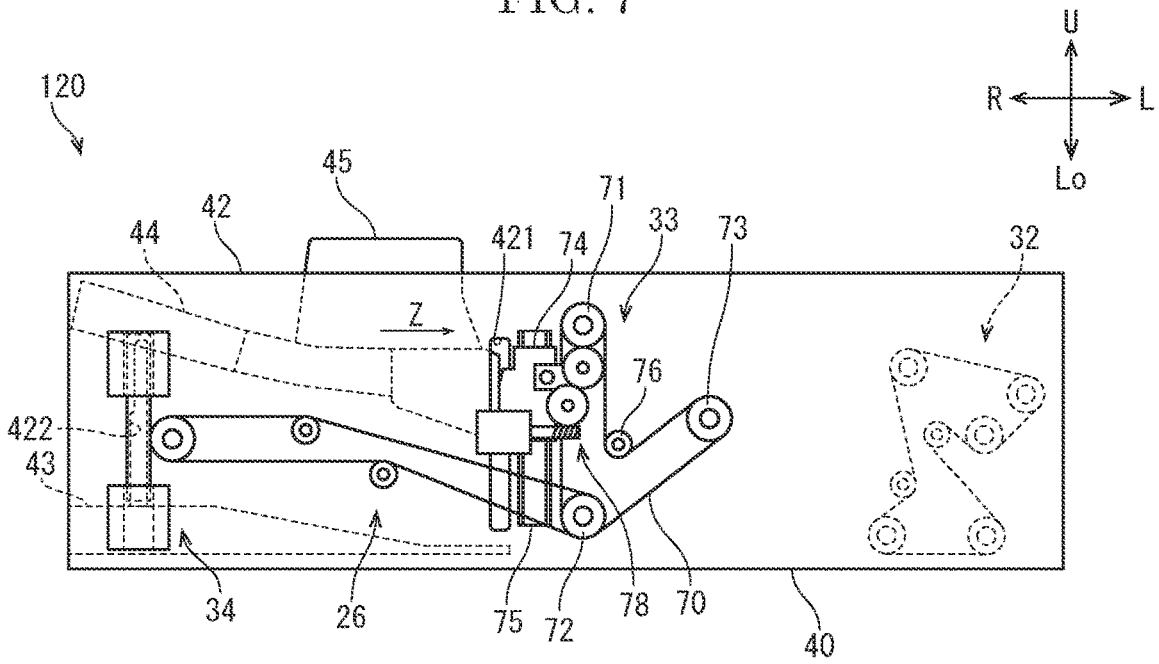
FIG. 7 is a rear view schematically showing a second lifting mechanism and a driving part according to the embodiment of the present disclosure.
Figure 8:
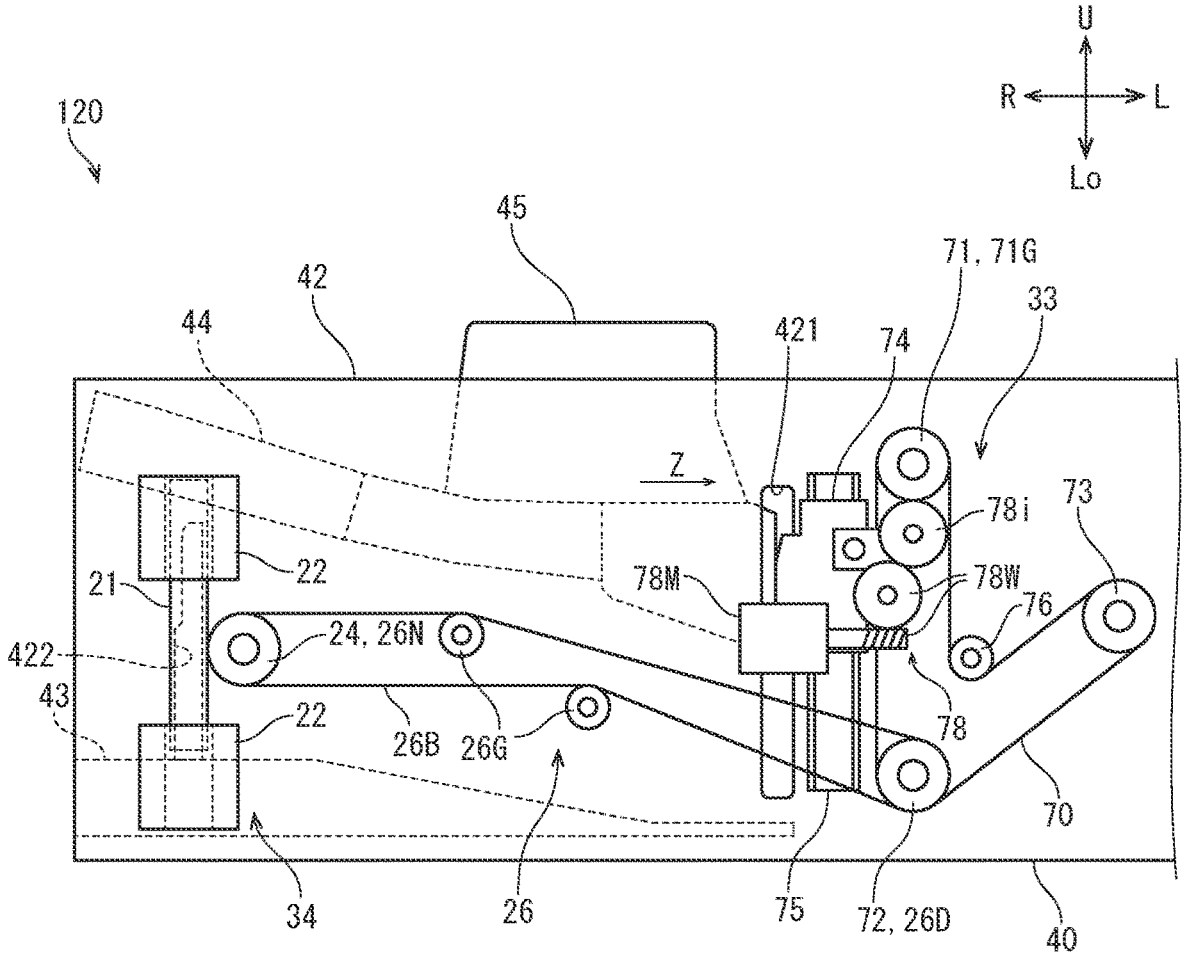
FIG. 8 is an enlarged view showing a key part of FIG. 7.

[Document Conveying Device] Next, the document conveying device 120 will be described. FIG. 2 is a perspective view showing the appearance of the document conveying device 120. FIG. 3 is a perspective view showing a support member 23 and its periphery. FIG. 4 is a front view schematically showing a sheet feeding mechanism 31 and a conveying mechanism 32. FIG. 5 and FIG. 6 are front views schematically showing the conveying mechanism 32 and a first lifting mechanism 33. Of these, FIG. 5 shows the sheet feeding tray 44 positioned at the upper limit position, and FIG. 6 shows the sheet feeding tray 44 positioned at the lower limit position. FIG. 7 is a rear view schematically showing a second lifting mechanism 34 and a driving part 78. FIG. 8 is an enlarged view showing a key part of FIG. 7.

The document conveying device 120 includes a sheet feeding tray 44 on which a document G is stacked; a discharge tray 43 provided below the sheet feeding tray 43; a feeding roller 51 which feeds the document G on the sheet feeding tray 44 one by one; a first lifting mechanism 33 which supports both end portions of the sheet feeding tray 44 in a width direction intersecting a conveying direction Z of the document G on the sheet feeding tray 44, and lifts and lowers the sheet feeding tray 44 such that an upper surface of the document G comes in contact with the feeding roller 51; a conveying mechanism 32 which conveys the document G fed by the feeding roller 51 to the discharge tray 43 through a reading position; a support member 23 which supports the sheet feeding tray 44 on an upstream side of the first lifting mechanism 33 in the conveying direction Z; and a second lifting mechanism 34 which lifts and lowers the support member 23 in synchronization with the sheet feeding tray 44.

The document conveying device 120 (see FIG. 2) has a generally rectangular bottom portion 40 formed into a flat shape, and a first wall portion 41 and a second wall portion 42 facing each other in the front-and-rear direction (in the width direction intersecting the conveying direction Z of the document G). The rear edge portion of the bottom portion 40 is hinged behind the contact glass 85 of the scanner 110. The bottom portion 40 also functions as a presser plate to press the document G on the contact glass 85. The first wall portion 41 is provided from the left end portion to the center portion of the front edge portion of the bottom portion 40. The second wall portion 42 is provided over the rear edge portion of the bottom portion 40. A cover 46 covers the upper and left sides of the space between the first wall portion 41 and the second wall portion 42. The left lower end portion of the cover 46 is hinged to the left end portion of the bottom portion 40.

[Sheet Feeding Try] The sheet feeding tray 44 is provided on the right side of the center portion in the left-and-right direction of the document conveying device 120 and on the front side of the second wall portion 42. The sheet feeding tray 44 is a plate-like member inclined with its left side downward. On the upper surface of the sheet feeding tray 44, a pair of cursors 45 are provided to align the front and rear ends of the document G.

[Discharge Tray] The discharge tray 43 is provided below the sheet feeding tray 44. The discharge tray 43 is integral with the bottom portion 40. On the center portion in the left-and-right direction of the discharge tray 43, an inclined surface with its left wide downward is provided.

[Sheet Feeding Mechanism] The sheet feeding mechanism 31 (see FIG. 4) is provided in the space between the first wall portion 41 and the second wall portion 42. The sheet feeding mechanism 31 has a box-shaped holder 53 with the lower surface opened. Inside the holder 53, the feeding roller 51, a driven roller 55, a driving roller 52 and an endless belt 56 are arranged with their axial directions along the front-and-rear direction. The driven roller 55 is disposed on the left side of the feeding roller 51. The driving roller 52 is disposed on the left side of the driven roller 55. The endless belt 56 is wound around the driving roller 52 and the driven roller 55. An auxiliary roller 57 with its axial direction along the front-and-rear direction is pressed against the lower surface of the lower part of the endless belt 56.

Both the front and rear end portions of the driving shaft 54 of the driving roller 52 are supported by the first wall portion 41 and the second wall portion 42, and are connected to a driving part (not shown) that includes a motor and a reduction gear. The holder 53 is supported by the driving shaft 54, and is swingable around the driving shaft 54. The driving force of the driving shaft 54 is transmitted to the feeding roller 51 by a transmission mechanism (not shown) such as a gear train or an endless belt.

A sensor 58 detects the sheet feeding tray 44 positioned at which the document G can be fed. The sensor 58 is a transmission or reflection type optical sensor, and is provided on the inner surface of the cover 46. A light shielding plate 59 projecting upward or sideways is provided on the upper portion of the holder 53.

[First Lifting Mechanism] The first lifting mechanism 33 (see FIG. 5 to FIG. 8) is provided on the front surface of the first wall portion 41 and the rear surface of the second wall portion 42. A driving pulley 71 and a driven pulley 72 (see FIG. 7 and FIG. 8) are provided above and below the center of the rear surface of the second wall portion 42, respectively. A driven pulley 73 is provided at a height between the driving pulley 71 and the driven pulley 72 and on the left side of the driving pulley 71 and the driven pulley 72. A guide pulley 76 is provided on the left upper side of the driven pulley 72 and on the right side of the driven pulley 73. An endless belt 70 is wound around the driving pulley 71, the driven pulleys 72 and 73 and the guide pulley 76. A driving part 78 includes a motor 78M, a worm gear 78W, an idler gear 78*i* and a driving gear 71G. The driving gear 71G is coupled to the shaft of the driving pulley 71.

Driven pulleys 91, 92 and 93 and a guide pulley 96 (see FIG. 5) are provided on the front surface of the first wall portion 41 at positions facing the driving pulley 71, the driven pulleys 72, 73 and the guide pulley 76, respectively. An endless belt 90 is wound around the driven pulleys 91, 92 and 93 and the guide pulley 96. The driven pulley 93 is coupled to the common shaft with the driven pulley 73.

A sliding part 74 (see FIG. 8) is provided at the left end portion of the rear edge portion of the sheet feeding tray 44. The second wall portion 42 has a first slit 421 whose longitudinal direction is along the upper-and-lower direction. The first slit 421 is provided at a position corresponding to the left end portion of the rear edge portion of the sheet feeding tray 44. The sliding part 74 is connected to the endless belt 70 between the drive pulley 71 and the driven pulley 72 through the first slit 421.

A lifting guide part 75 is provided on the rear surface of the second wall portion 42. The lifting guide part 75 is a rail-like member whose longitudinal direction is along the upper-and-lower direction. The sliding part 74 can slide upward and downward along the lifting guide part 75.

A sliding part 94 (see FIG. 5) is provided at the left end portion of the front edge portion of the sheet feeding tray 44. The sliding part 94 is connected to the endless belt 90 between the driven pulley 91 and the driven pulley 92.

A lifting guide part 95 is provided on the front surface of the first wall portion 41. The lifting guide part 95 is a rail-like member whose longitudinal direction is along the upper-and-lower direction. The sliding part 94 can slide upward and downward along the lifting guide part 95.

The basic operation of the first lifting mechanism 33 is as follows. The driving force generated by the motor 78M is transmitted to the driving gear 71G via the worm gear 78W and the idler gear 78*i*. The endless belt 70 travels by the rotation of the driving pulley 71 together with the driving gear 71G, and the driven pulleys 72 and 73 are rotated accordingly. When the driven pulley 93 is rotated together with the driven pulley 73, the endless belt 90 travels in synchronization with the endless belt 70. Since the sheet feeding tray 44 is connected to the endless belts 70 and 90 via the sliding parts 74 and 94, the forward and reverse rotation of the motor 78M lifts and lowers the sheet feeding tray 44.

The controller 2 makes the first lifting mechanism 33 lift the sheet feeding tray 44 on which the document G is stacked. When the upper surface of the document G is pressed against the feeding roller 51, the holder 53 swings upward. When the holder 53 swings upward by a predetermined amount, the light shielding plate 59 blocks the light of the sensor 58. At this time, an appropriate load acts between the upper surface of the document G and the feeding roller 51, and the document G can be fed by the feeding roller 51.

[Conveying Mechanism] The conveying mechanism 32 (see FIG. 4) includes a conveyance path 61 from the sheet feeding mechanism 31 to an opening 40A, a conveyance path 64 from the opening 40A to the discharge roller 69, and a plurality of conveying rollers 62 arranged on the conveyance paths 61 and 64. The opening 40A is an example of the reading position where the scanner 110 reads the document G. The opening 40A is a slit whose longitudinal direction is along the front-and-rear direction, provided in a region of the bottom portion 40 facing the first carriage 81 (see FIG. 1) moved at the home position. The conveyance paths 61 and 64 are each mainly formed of plate-like members facing each other with a gap through which the document G can pass. At the reading position, an opening 61A corresponding to the opening 40A is provided in the plate member on the lower side of the conveyance path 61, and the lower surface of the document G being conveyed is exposed through the opening 40A and the opening 61A.

The conveying roller 62 includes a driving roller and a driven roller. A driven pulley 62P (see FIG. 5) is coupled to the shaft of the driving roller. A driving pulley 63P is connected to a driving part (not shown) including a motor and a reduction gear. An endless belt 60 is wound around the driving pulley 63P, a plurality of the driven pulleys 62P and a guide pulley 65. When the driving pulley 63P is driven, the driven pulleys 62P rotate synchronously by the traveling of the endless belt 60, so that the conveying rollers 62 also rotate synchronously.

[Support Member] The support member 23 (FIG. 2, FIG. 3, FIG. 5 to FIG. 8) supports the sheet feeding tray 44 on the upstream side of the first lifting mechanism 33 in the conveying direction Z of the document G. Specifically, the support member 23 is provided in front of the second wall portion 42 (see FIG. 2 and FIG. 3) and supports the rear end portion in the width direction of the sheet feeding tray 44. The user faces the front surface of the image forming apparatus 100, places the document G on the sheet feeding tray 44, removes the document G from the discharge tray 43, and operates the display operation part. The rear end portion in the width direction of the sheet feeding tray 44 shows the rear end portion of the sheet feeding tray as seen from the user, that is, the rear end portion of the sheet feeding tray 44.

The support member 23 supports a slightly left side portion from the right end portion of the rear end portion of the sheet feeding tray 44. The lower surface of the sheet feeding tray 44 is inclined such that the left side is lower. On the lower surface of the sheet feeding tray 44, a contact part 44C protruding downward is provided at a slightly left side position from the right end portion of the rear end portion. The lower surface of the contact part 44C is formed approximately horizontally. The support member 23 is formed in a square columnar shape, and has an approximately horizontal upper surface. The upper surface of the support member 23 comes into contact with the lower surface of the contact part 44C of the sheet feeding tray 44.

[Second Lifting Mechanism] The second lifting mechanism 34 is provided on the rear surface of the second wall portion 42 (see FIG. 7 and FIG. 8). The second lifting mechanism 34 is, for example, a rack and pinion. The second wall portion 42 has a second slit 422 whose longitudinal direction is along the upper-and-lower direction, at a position corresponding to the support member 23 (see FIG. 2, FIG. 3, FIG. 7 and FIG. 8). A rack 21 whose longitudinal direction is along the upper-and-lower direction is provided behind the second slit 422. A tooth is formed on the left side surface of the rack 21, and a pinion 24 is provided on the left side of the rack 21.

Above and below the second slit 422, a rack guide 22 is provided to guide the rack 21. The rack guide 22 regulates the horizontal movement of the rack 21 and guides the upper-and-lower directional movement of the rack 21. The rack 21 and the support member 23 face each other across the second slit 422. In the front portion of the rack 21, a forward-projecting rack connection portion 21C is provided (see FIG. 3). The rack connection portion 21C is coupled to the support member 23 through the second slit 422.

A distribution part 26 (see FIG. 7 and FIG. 8) distributes the driving force generated by the driving part 78 to the second lifting mechanism 34. Specifically, a driving pulley 26D is provided on the shaft of the driven pulley 72. A driven pulley 26N is provided on the shaft of the pinion 24. A guide pulley 26G is provided on the right side of the driving pulley 26D and on the left side of the pinion 24. An endless belt 26B is wound around the driving pulley 26D, the driven pulley 26N and the guide pulley 26G.

The operation of the document conveying device 120 is as follows. In FIG. 8, when the endless belt 70 is driven in the clockwise direction, the sliding part 74 is lifted and thus the sheet feeding tray 44 is lifted. At this time, the pinion 24 is also driven in the clockwise direction through the endless belt 26B, so that the support member 23 is lifted together with the rack 21.

On the other hand, when the endless belt 70 is driven in the counterclockwise direction, the sliding part 74 is lowered and thus the sheet feeding tray 44 is lowered. At this time, the pinion 24 is also driven in the counterclockwise direction through the endless belt 26B, so that the support member 23 is lowered together with the rack 21.

In both cases, since the upper surface of the support member 23 is in contact with the lower surface of the sheet feeding tray 44, the load acting on the sheet feeding tray 44 (the gravity acting on the stacked document G) is distributed between the first lifting mechanism 33 and the second lifting mechanism 34. As a result, the posture change and deformation of the sheet feeding tray 44 can be suppressed compared with the case where the load is supported only by the first lifting mechanism 33.

The document conveying device 120 according to the present embodiment described above includes the sheet feeding tray 44 on which a document G is stacked; the discharge tray 43 provided below the sheet feeding tray 43; the feeding roller 51 which feeds the document G on the sheet feeding tray 44 one by one; the first lifting mechanism 33 which supports both end portions of the sheet feeding tray 44 in a width direction intersecting a conveying direction Z of the document G on the sheet feeding tray 44, and lifts and lowers the sheet feeding tray 44 such that an upper surface of the document G comes in contact with the feeding roller 51; the conveying mechanism 32 which conveys the document G fed by the feeding roller 51 to the discharge tray 43 through a reading position; the support member 23 which supports the sheet feeding tray 44 on an upstream side of the first lifting mechanism 33 in the conveying direction Z; and the second lifting mechanism 34 which lifts and lowers the support member 23 in synchronization with the sheet feeding tray 44. With this configuration, the posture change and deformation of the sheet feeding tray 44 when the document G is loaded can be suppressed.

In addition, according to the document conveying device 120 according to the present embodiment, the support member 23 supports the rear end portion in the width direction of the sheet feeding tray 44. With this configuration, the support member 23 can be prevented from interfering with the user's work.

According to the document conveying device 120 according to the present embodiment, the support member 23 is in contact with the lower surface of the sheet feeding tray 44. With this configuration, the sheet feeding tray 44 can be supported with a simple configuration.

In addition, the document conveying device 120 according to the present embodiment includes the driving part 78 for driving the first lifting mechanism 33 and the distribution part 26 for distributing the driving force generated by the driving part 78 to the second lifting mechanism 34. With this configuration, the second lifting mechanism 34 can be driven without providing the driving part 78 in the second lifting mechanism 34 separately from the first lifting mechanism 33.

In addition, according to the document conveying device 120 according to the present embodiment, the second lifting mechanism 34 includes the pinion 24 which rotates by the driving force distributed from the distribution part 26, and the rack 21 whose longitudinal direction is along the upper-and-lower direction and which meshes with the pinion 24, and the support member 23 is connected to the rack 21. With this configuration, the second lifting mechanism 34 can be constructed with high rigidity.

The above embodiment may be modified as follows.

The above embodiments show an example where the support member 23 supports the rear end portion in the width direction of the sheet feeding tray 44, but the support member 23 may support the front end portion in the width direction in addition to the rear end portion in the width direction of the sheet feeding tray 44.

The above embodiments show an example where the support member 23 is in contact with the lower surface of the sheet feeding tray 44, but the support member 23 may be connected to the sheet feeding tray 44. In this case, it is desirable that the sheet feeding tray 44 be pin-jointed so that no bending moment occurs.

The above embodiments show an example where the distribution part 26 is provided, but instead of the distribution part 26, a driving part 78 for driving the second lifting mechanism 34 may be provided.

The above embodiment shows an example where the second lifting mechanism 34 is a rack-and-pinion, but the second lifting mechanism 34 may be a cam, ball screw, or the like.

The invention claimed is:

1. A document conveying device comprising:

a sheet feeding tray on which a document is stacked;

a discharge tray provided below the sheet feeding tray;

a feeding roller which feeds the document on the sheet feeding tray one by one;

a first lifting mechanism which supports both end portions of the sheet feeding tray in a width direction intersecting a conveying direction of the document on the sheet feeding tray, and lifts and lowers the sheet feeding tray such that an upper surface of the document comes in contact with the feeding roller;

a conveying mechanism which conveys the document fed by the feeding roller to the discharge tray through a reading position;

a support member which supports the sheet feeding feed tray on an upstream side of the first lifting mechanism in the conveying direction; and a second lifting mechanism which lifts and lowers the support member in synchronization with the sheet feeding tray.

2. The document feeding device according to claim 1, wherein the support member supports a rear end portion of the sheet feeding tray in the width direction.

3. The document feeding device according to claim 1, wherein the support member is in contact with a lower surface of the sheet feeding tray.

4. The document feeding device according to claim 1, comprising:

a driving part which drives the first lifting mechanism; and a distribution part which distributes a driving force generated by the driving part to the second lifting mechanism.

5. The document conveying device according to claim 4, wherein the second lifting mechanism includes:

a pinion rotated by a driving force distributed from the distribution part; and a rack provided along an upper-and-lower direction and meshing with the pinion, and the support member is connected to the rack.

* * * * *